US006599205B1

(12) United States Patent
Andrews et al.

(10) Patent No.: US 6,599,205 B1
(45) Date of Patent: Jul. 29, 2003

(54) COMBINATION BALL MARKER AND TURF REPAIR GOLF TOOL PROMOTIONAL DEVICE

(76) Inventors: Ryan F. Andrews, 4126 Center St., Culver City, CA (US) 90232; Robin A. Florence Andrews, 4126 Center St., Culver City, CA (US) 90232

( * ) Notice: Subject to any disclaimer, the term of this patent is extended or adjusted under 35 U.S.C. 154(b) by 0 days.

(21) Appl. No.: 10/071,445

(22) Filed: Feb. 7, 2002

(51) Int. Cl.[7] ..... A63B 57/00
(52) U.S. Cl. ..... 473/408; 473/406
(58) Field of Search ..... 473/406, 408, 473/286; D21/713

(56) References Cited

U.S. PATENT DOCUMENTS 3,415,518 A * 12/1968 Root ..... 473/408
3,620,426 A 11/1971 Hatch
4,114,878 A 9/1978 Hammond
5,110,123 A 5/1992 Larson
5,295,683 A 3/1994 Tate
D345,776 S * 4/1994 Williams ..... D21/793
5,393,052 A 2/1995 Kennedy
6,033,322 A 3/2000 England

* cited by examiner

*Primary Examiner*—Steven Wong
(74) *Attorney, Agent, or Firm*—Sherman D. Pernia

(57) ABSTRACT

The present combination golf device comprises two unitary components: a golf ball marker and turf repair tool. The turf repair tool component is rod-like and hairpin shaped with two arms. The tool has a constricted section proximate the base of the hairpin forming a loop section therein. The arms extend proximately in parallel from the constriction section and terminating in a blunt end. The ball marker component is wafer shaped with a front and back surfaces. An attachment structure is disposed on the back surface of the ball marker and attaches the ball marker to the loop of the turf repair tool. Both components of the device have a message display surface where advertising, promotional of other message media may be displayed. The entire device is made of a safety material that is non-magnetic and relatively soft.

17 Claims, 3 Drawing Sheets

COMBINATION BALL MARKER AND TURF REPAIR GOLF TOOL PROMOTIONAL DEVICE

FIELD OF THE INVENTION

The present invention is in the field of promotional or advertising devices that are also ancillary to games using tangible projectiles, and specifically to the game of golf. More particularly, the present invention relates to a promotional device that is also a combination player manipulated turf repair tool and golf ball marker.

BACKGROUND OF THE INVENTION

In playing golf, a large variety of accessories are used to help enhance the enjoyment of the game. Among these accessories are divot or turf repair tools. Turf repair tools are used to lift up grass on a golf green that has been depressed by the impact of a golf ball or golf club. Repairing the divot allows the turf to recover more quickly from the impact, which promotes the integrity of the green and allowing for a smooth putting surface. Ball markers are also used on the golf green to mark the location of a golf ball on the green, allowing play by following players. In order to minimize the number of items a player must personally carry and keep track of, the field has been motivated to develop combination divot repair tools and ball marker holders.

Examples of such combined divot repair and ball marker holders include those disclosed by England, U.S. Pat. No. 6,033,322 and Tate, U.S. Pat. No. 5,295,683. Both patents disclose a golf tool consisting of a divot repairer, a magnetic marker holder and a metallic ball marker. A metallic golf ball marker with or without a stem or post is held in place in the magnetic holder. However, a magnetized golf tool has a potential disadvantage. In present times, with the high probability that a golfer is carrying magnetic sensitive media (e.g., a credit card or a computer disk), there is the risk of compromising the magnetic media if the magnetized material of the golf tool is placed in proximity of the magnetic media (e.g., in the same pocket, purse or brief case).

Larson, U.S. Pat. No. 5,110,123 also discloses a golf tool combining a turf repair tool and a pair of ball markers. The pair of ball markers consist of two individual markers that latch together through a series of legs and undercuts. The divot repair tool is made of stiff wire with a bent-back, V-shaped portion and undulated prongs (legs). The bent-back, V-shaped portion of the tool forms a space or slot with the prongs for receiving the assembled ball markers. The assembled ball markers are releaseably held in this slot by passing the prongs through the space in between the assembled ball markers. Although the Larson device may be useful for its intended purpose, it requires the extra step of joining of a pair of ball markers to form a marker assembly, before of the repair tool can be inserted into the marker assembly and accomplish the combination device.

Hatch, U.S. Pat. No. 3,620,426 discloses another turf repair tool combined with a ball marker and a carrying case. The repair tool is a flat body member having a first end portion to function as a handle, and a second end portion that tapers into a fork shaped pair of prongs. The ball marker has a circular head and central stem or post which fits into a grommet mounted in the intermediate portion of the body. The ball marker of the Hatch device only has a single post for engaging the turf when used to indicated the position of a golf ball on the green.

Other combination golf tools include Kennedy, U.S. Pat. No. 5,393,052 and Hammond, U.S. Pat. No. 4,114,878.

Kennedy describes a combination divot repairer, club holder and ball marker holder. The ball marker is received in a recess or slot at the handle end of the tool, and retained there until use apparently by friction fit. Hammond discloses a golf tee with an attached divot repair tool which contains a ball marker. The Hammond device utilizes a golf tee of any suitable design connected by a high tensile flexible cord to an anchor/green groomer. The ball marker is held in an aperture or through-bore in the body of the tool by the single center post or shaft of the ball marker.

Although each of the above devices may be useful for its intended purpose, it would be beneficial to have an alternative combination divot repair tool and golf ball marker system which is simply constructed of only two components and of a safe, non-magnetic material. It would be further beneficial if the safe material was not only non-magnetic, but also would not damage mower blades when lost tools are run over by grounds keeping equipment. A still further benefit would be to have a message surface incorporated into either or both components of the combination device, to allow the device to also be easily utilized as a promotional or advertising item.

SUMMARY OF THE INVENTION

The present invention is a promotional device and safety golf tool system for use in the game of golf. The system is the combination of a golf ball position marker and a turf repair tool in a single device that is transportable on one's person, for example, in a pocket, purse or in a bag or case. The system is accomplished by having the ball marker incorporate features for receiving and holding a turf repair tool. Therefore, the device consists of only two component parts: a unitary ball marker and a unitary turf repair tool. The safety features of the present invention are that its two component parts are constructed of materials that are non-magnetic and less likely to damage the mower blades of greens keeping equipment should a lost device be run over by such equipment.

The present device has multiple uses. The body of the device is a divot or turf repair tool and is useful for that purpose either as a separate component or in combination with the ball marker. The ball marker component is removable from the turf repair tool component, and separately useful for that purpose. The features of the device that removably attach the two components of the device together are integral to the ball marker component. The attachment features also serve the purpose of helping to anchor or maintain the position of the ball marker when it is placed on the turf to mark a golf ball location. For use to as a turf repair tool, the device is grasped by the loop section (with or without the ball holder in place at the loop section) and the arm pins are inserted into the ground to raise the divot and flatten the surface of the turf.

Another use of the present device is as a promotional or advertising device. One or more message display surfaces are included on the device for presenting a promotional or advertising message. The message surfaces are a surface that is integral to the ball marker or the turf repair tool.

The turf repair tool component of the present device is rod-like and has a hairpin-like configuration or shape. The hairpin shape has a base portion and two arms. A section of the hairpin shape proximate the base is indented or constricted to form a loop in the base portion of the hairpin shape. The arms are relatively parallel and extend away from the constriction section and each terminates in a blunt end. The loop section of the repair tool lies in a single plane, and the ball marker is removably attachable to the loop section from either side of the plane of the loop section. The outer surface of the rod-like shaped may serve as a message display surface where a promotional or advertising message may be displayed. The message may be printed, stamped, engraved or the like on the outer surface of the turf repair tool, for example, on the arms or the loop section.

The turf repair tool is constructed of a safety material. The safety material should be non-magnetic so as to not compromise any magnetic sensitive media (e.g., a credit card or a computer disk) that it may come in proximity with. Also, the safety material should be light weight and relatively soft, such as a plastic or relatively soft, light weight metal. Aluminum, plastic, brass, copper and any soft, non-magnetic metal are examples of materials that can be used to practice the present invention.

The arms of the repair tool have a reach dimension. The reach dimension is the length of the arm from the constriction section to the terminal end of the arm. The reach dimension ranges from about 4 centimeters to about 7 centimeters, depending on the physical characteristics of the material used to construct the tool, the intended function of the tool (deep turf repair versus shallow), and the desired degree of personal portability for the tool. The terminal ends of the arms are blunted to avoid damage to clothing and the like when the present device is carried on one's person.

The turf repair tool is rod-like having a substantially uniform cross-section. The cross-section of a turf tool has a cross-sectional dimension ranging from about 2 millimeters to about 5 millimeters. The size of the cross-section depends primarily on the material of which the tool is constructed. Weaker materials may require the tool to have a larger cross-section to provide sufficient structural integrity to the tool to reduce or prevent its bending or breaking in use. Typically, the turf repair tool has a cross-sectional configuration that is substantially circular in shape. However, other shapes, such as ovals, squares, oblongs and the like are also practicable in the present invention. The hairpin shaped repair tool has an overall length from the base to the tool to the blunt ends of the arms ranging from about 7 centimeters to about 10 centimeters.

The ball marker of the present invention has a wafer shape with a front surface and a back surface. The front surface of the ball marker includes a message display surface. An advertising or promotional message may be displayed on the message surface by printing, molding, embossing or adhering the message to the message surface. The back surface of the ball marker is where the attachment means is disposed for attaching the ball marker to the loop section of the turf repair tool. The attachment means is comprised of a set of detent posts integrally disposed on the back surface of the ball marker. The detent posts not only serve as an attachment mechanism between the repair tool and the ball marker, the posts also serve as an anchor post for engaging the turf when the ball marker is removed from the turf tool and used to mark a golf ball location on a green. The height of the post (how far they extend away from the back surface of the ball marker) may be selected to provide the degree of purchase or anchoring of the ball marker with the turf as desired. The longer the posts, the greater the purchase or anchoring. Optionally, a specific anchor post may be included on the back surface of the ball marker, in addition to the detent posts.

The attachment means set of detent post was specifically developed for practice in the present invention. The set of detent posts comprises at least one inner detent post and at least two outer detent posts. One or more inner detent posts contact and receive the turf repair tool on at a surface inside of the loop section of the tool, proximate the base. At least two outer detent posts contact and receive the repair tool at its surface outside of the loop, proximate to and one detent on either side of the constriction section. The described configuration of the locations of the detent posts was specifically designed to be practiced on the repair tool of the present invention. The present attachment means design proved to be functional even when other designs failed due to distortion of the hairpin shape or spreading of the arms of the repair tool with continuing use. In fact, the disclosed design provided to help maintain the proper spatial relationship between of the arms of the tool. The practice of alternative attachment means in the present invention by one of ordinary skill in the art must take the same functional requirements into consideration.

DETAILED DESCRIPTION OF THE INVENTION

Figure 1A:
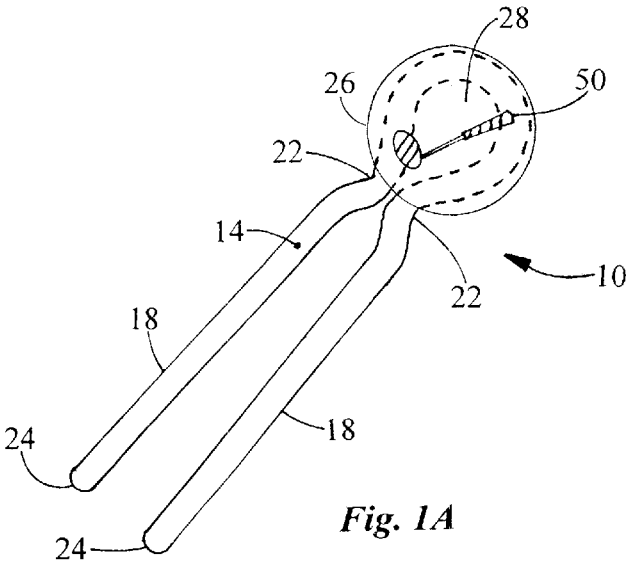
FIG. 1A is a top plan view of the combination turf repair tool and golf ball marker system of the present invention.

Referring now to the drawings, the details of preferred embodiments of the present invention are graphically and schematically illustrated. Like elements in the drawings are represented by like numbers, and any similar elements are represented by like numbers with a different lower case letter suffix. It may be seen from the drawings that the present invention is a promotional and safety golf tool system comprised of a combination device having two unitary component parts: a ball marker component and a turf repair tool component. Each component has a message surface on which an advertising or promotional massage may be displayed.

Figure 1B:
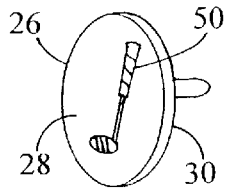
FIG. 1B is a perspective view of a ball marker component showing a front surface which is a message surface having a golf club logo.
Figure 1C:
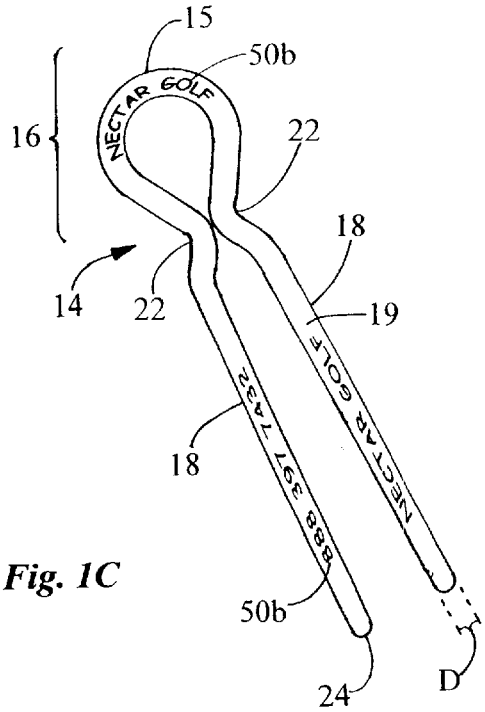
FIG. 1C is a top view of a divot or turf repair tool component of the present invention.

FIGS. 1A to 1C exemplify a preferred embodiment of the combination divot repair and golf ball marker tool device 10. As shown in FIGS. 1A and 1B, the present device 10 comprises a turf repair tool 14 which has a rod-like construction and is configured in a hairpin shape, having a base 15 and two arms pins 18. The repair tool 14 has a constriction section 22 proximate the base 15 of the hairpin shape forming a loop 16 at the base 15 end of the tool 14. The arms 18 of the tool 14 extend away from the constriction section 22 of the tool 14 proximately in parallel with each other, terminating in a blunt end 24. The loop 16 of the repair tool 14 lies in a single plane, and the ball marker 26 is removably attachable to the loop 16 section of the turf tool 14 from either side of the plane of the loop 16. The rod-like shaped repair tool 14 has an outer surface 19 that is also a message display surface 50*b* (see FIG. 1C).

Figure 1D:
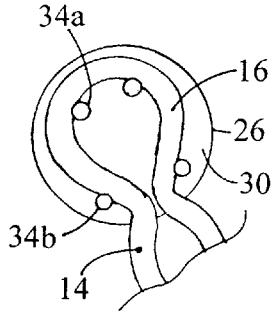
FIG. 1D is a bottom plan view of the base portion of the combination turf repair tool and golf ball marker system of the present invention showing the repair tool attached to the bottom surface of the ball marker by a detent post attachment means.

As shown in FIG. 1B, the golf ball marker 26 component of the device 10 is a flat wafer-like object. The ball marker 26 has a front surface 28 and a back surface 30. On the back surface 30 of the ball marker 26 is disposed an attachment means 34. In a preferred embodiment exemplified in FIG. 1D, the attachment means 34 is a set of detent posts 34*a* & 34*b* integral to the back surface 30 of the ball marker 26. The detent posts 34*a* & 34*b* receive and releaseably attach the loop 16 of the turf repair tool 14 to the back surface 30 of the ball marker 26. (Also see FIGS. 5A–5D).

The turf repair tool 14 is constructed of a safety material that is a relatively soft, non-magnetic material. Appropriate safety materials include: aluminum, plastic, brass, copper and any other relatively soft, non-magnetic metal. In a preferred embodiment, the turf repair tool 14 was constructed of aluminum wire having a diameter of about 3 millimeters and an overall length of about 7.5 centimeters (3 inches). The turf repair tool 14 has a rod-like construction and a substantially uniform cross-section. Preferably, the cross-section of the turf tool 14 is substantially circular and has a dimension D (see FIG. 1C) ranging from about 2 millimeters to about 5 millimeters. The overall length L of the turf tool 14 from the base 15 of the tool to the blunt ends 24 of the arms 18 preferably ranges from about 6 centimeters to about 10 centimeters. The arms or arm pins 18 of the turf repair tool 14 have a reach dimension R, which is the distance from the constrictions 22 to the blunt ends 24 and ranges from about 4 centimeters to about 7 centimeters. Preferably, the arms 18 are proximately parallel to each other, within about 0.5 cm or so over their length.

To repair a divot, the turf repair tool component 14 is held by its loop 16, with or without a ball marker 26 attached to the tool 14. The ends 24 of the arm pins 18 of the repair tool 14 are inserted into the turf of a divot on the green and used as a lever to lift and decompress the turf of the divot. The divot is then evened out, allowing for a smoother and more rapidly recovering greens surface.

Figure 3:
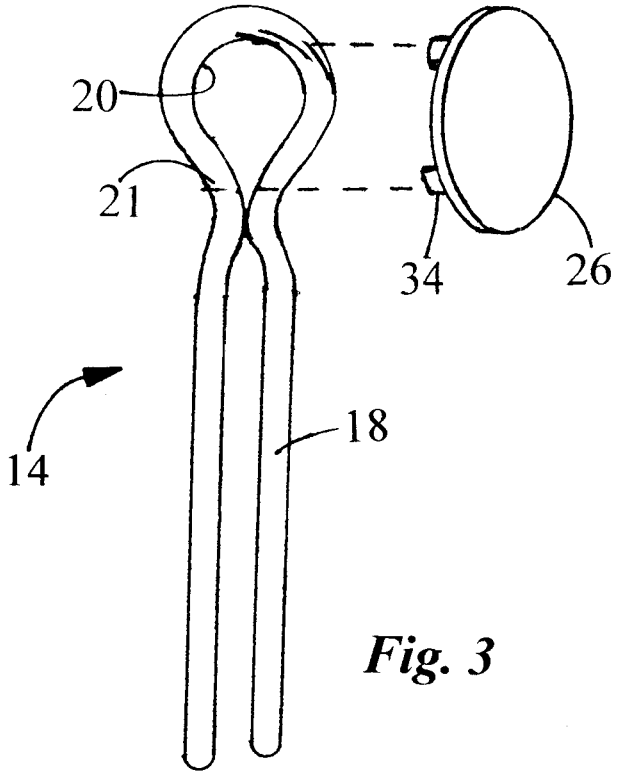
FIG. 3 is a perspective view of the combination divot repair tool and golf ball marker device showing the golf ball marker component of the present invention positioned for attachment to the loop section of the turf repair tool component.
Figure 2:
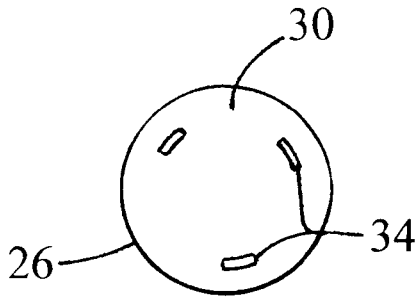
FIG. 2 is a bottom plan view of the back surface of the golf ball marker showing an alternative placement of a set of detents.

The ball marker 26 of the present invention 10 is wafer shaped and has a front surface 28 and a back surface 30 (see FIG. 1B). Preferably, the ball marker is made of plastic or other safety material. FIG. 2 shows the back surface 30 of a ball marker 26 where the attachment means 34 are disposed for attaching the ball marker 26 to the loop 16 of the turf repair tool 14. The relationship of the ball marker 26 to the turf repair tool 14 is shown in FIG. 3. As shown in FIGS. 5A to 5D, the attachment means 34 is a set of detent posts 34*a*–34*d* projecting from the back surface 30 of the ball marker 26. The attachment means 34 comprises at least one inner detent post 34*a* and at least two outer detent posts 34*b* (see also FIG. 1D). The inner detent post 34*a* contacts and receives a surface 20 (see FIG. 3) of the turf repair tool 14 on an inside of the loop 16 section proximate the base 15, and the outer detent posts 34*b* contact and receive the surface 21 (see FIG. 3) of the repair tool 14 on an outside of the loop proximate the constriction section.

The detent posts 34 not only serve as an attachment mechanism between the repair tool 14 and the ball marker 26, the posts also serve as an anchor post for engaging the turf when the ball marker 26 is removed from the turf tool 14 and used to mark a golf ball location on a green. The height of the detent post 34 (how far they extend away from the back surface 30 of the ball marker 26) may be selected to provide the degree of purchase or anchoring of the ball marker 26 with the turf as desired. The longer the detent posts 34, the greater the potential purchase or anchoring effect of the post. Optionally, a specific or dedicated anchor post 35 (see FIG. 5D) may be included on the back surface 30 of the ball marker 26, in addition to the detent posts 34. The front surface 28 of the ball marker includes a message display surface. An advertising or promotional message 50 (see FIGS. 1A and 1B) may be displayed on the message surface by printing, molding, embossing or adhering the message 50*a* (see FIG. 4) to the message surface.

Figure 4:
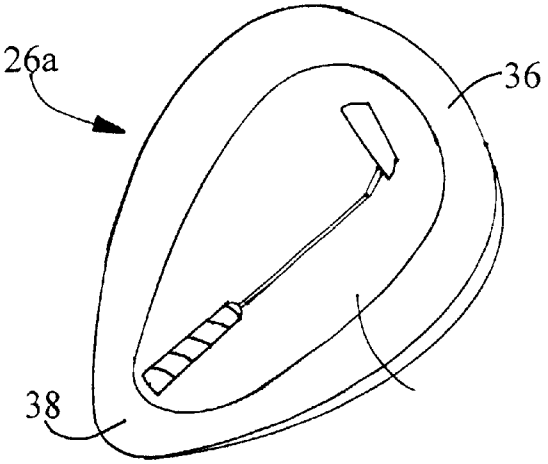
FIG. 4 is a perspective view of an alternative wafer shape for a golf ball marker.
Figure 5D:
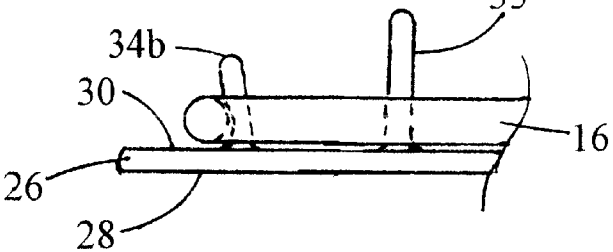
FIGS. 5A to 5D are partial side views of a combined turf tool and ball marker of the present invention showing the relationship of various attachment means to the back surface of the ball marker and the turf repair tool.
Figure 5C:
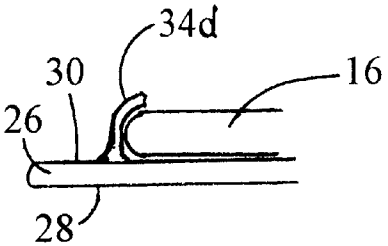
Figure 5B:
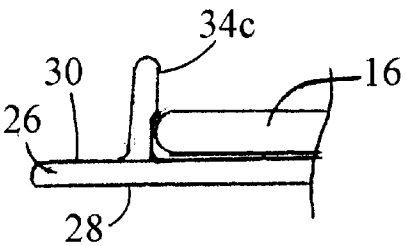
Figure 5A:
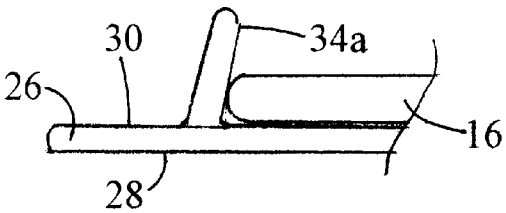

As shown in the figures, the ball marker 26 is preferably a circular disk shaped structure with a front surface 28, a back surface 30 with attachment means 34. The front surface 28 of the ball marker 26 may be fitted by imprinting or other means with various designs, emblems, logos, insignia or other advertising or promotional messages 50. Alternatively, as shown in FIG. 4, the ball marker 26*a* may have a shape or configuration other than circular. The oval shaped ball marker 26*a* of FIG. 4 has a base end 36 and a constriction end 38.

The detent posts 34 allow for easy attachment or removal of the ball marker 26 from the loop 16 of the divot repair tool 14 component of the present device 10. To attach the turf tool 14 to the ball marker 26, the detent posts 34 on the back surface 30 of the ball marker 26 are lined up with the loop 16 of the turf tool 14, and the ball marker 26 pushed (e.g., with the user's thumb) into engagement with the loop 16 of the turf tool 14 as exemplified in FIG. 1D. To release the ball marker 26, the ball marker 26 is pried or pushed from through the open side of the loop 16.

While the above description contains many specifics, these should not be construed as limitations on the scope of the invention, but rather as exemplifications of one or another preferred embodiment thereof. Many other variation are possible, which would be obvious to one skilled in the art. Accordingly, the scope of the invention should be determined by the scope of the appended claims and their equivalents, and not just by the embodiments.

What is claimed is:

1. A promotional device and safety golf tool system including a combination ball marker and turf repair tool, the system comprising:

a turf repair tool, the turf repair tool being rod-like and hairpin shaped and having a base and two arms, with a constriction section proximate the base of the hairpin forming a loop section therein, and the arms extending proximately in parallel from the constriction section and terminating in a blunt end;

a ball marker having a wafer shape with a front surface and a back surface; and an attachment means disposed on the back surface of the ball marker for attaching the ball marker to the loop section of the turf repair tool.

2. The system of claim 1, further comprising a message display surface for presenting a promotional message, the message surface being a surface integral to the ball marker or the turf tool.

3. The system of claim 1, wherein the turf repair tool is constructed of a safety material.

4. The turf repair tool of claim 3, wherein the safety material is a relatively soft, non-magnetic material.

5. The turf repair tool of claim 3, wherein the safety material is a relatively soft, non-magnetic material selected from the group consisting of aluminum, plastic, brass, copper and a soft, non-magnetic metal.

6. The turf repair tool of claim 1, wherein the arms have a reach dimension from the constriction section to the blunt end ranging from about 4 centimeters to about 7 centimeters.

7. The system of claim 1, wherein the loop section of the repair tool lies in a single plane, and the ball marker is removably attachable to the loop section from either side of the plane of the loop section.

8. The turf repair tool of claim 1, wherein the rod-like shaped tool has a substantially uniform cross-section, and the cross-section having a dimension ranging from about 2 millimeters to about 5 millimeters.

9. The turf repair tool of claim 1, wherein the rod-like shaped tool has a cross-section that is substantially circular.

10. The turf repair tool of claim 1, further comprising the rod-like shaped tool having an outer surface that is a message display surface.

11. The turf repair tool of claim 1, wherein the rod-like and hairpin shaped tool has an overall length from the base of the tool to the blunt ends of the arms ranging from about 7 centimeters to about 10 centimeters.

12. The ball marker of claim 1, further comprising an anchor post extending vertically from the back surface of the ball marker, the anchor post for engaging turf when the ball marker is removed from the turf tool and used to mark a golf ball location.

13. The ball marker of claim 1, wherein the front surface includes a message display surface.

14. The system of claim 1, wherein the attachment means further comprises a set of detent posts disposed on the back surface of the ball marker.

15. The attachment means of claim 14, wherein the set of attachment means further comprises at least one inner detent post and at least two outer detent posts.

16. The set of detents of claim 14, wherein the inner detent post contacts and receives a surface of the turf repair tool on an inside of the loop section proximate the base, and the outer detent posts contact and receive the surface of the repair tool on an outside of the loop proximate the constriction section.

17. The attachment means of claim 14, wherein the set of detent posts also serve as anchor posts.

* * * * *